US005317304A

United States Patent [19]

Choi

[11] Patent Number: 5,317,304

[45] Date of Patent: May 31, 1994

[54] PROGRAMMABLE MICROPROCESSOR BASED MOTION-SENSITIVE ALARM

[75] Inventor: Alexander K. Choi, Cupertino, Calif.

[73] Assignee: Sonicpro International, Inc., Santa Clara, Calif.

[21] Appl. No.: 781,599

[22] Filed: Oct. 23, 1991

Related U.S. Application Data

[63] Continuation-in-part of Ser. No. 642,478, Jan. 17, 1991, abandoned.

[51] Int. Cl.[5] ..... G08B 13/14

[52] U.S. Cl. ..... 340/571; 340/568

[58] Field of Search ..... 340/568, 571, 572, 543, 340/566

[56] References Cited

U.S. PATENT DOCUMENTS

| | | | |
|---|---|---|---|
| 4,030,087 | 6/1977 | Ritchie | 340/571 |
| 4,327,360 | 4/1982 | Brown | 340/571 |
| 4,337,462 | 6/1982 | Lemelson | 340/568 |
| 4,833,456 | 5/1989 | Heller | 340/571 |
| 4,845,464 | 7/1989 | Drori | 340/566 |

FOREIGN PATENT DOCUMENTS

| | | | |
|---|---|---|---|
| 2593950 | 8/1987 | France | 340/571 |

*Primary Examiner*—Hezron E. Williams
*Assistant Examiner*—Christine K. Oda
*Attorney, Agent, or Firm*—Flehr, Hohbach, Test, Albritton & Herbert

[57] ABSTRACT

An anti-theft device and method includes a motion sensor for detecting motion and generating signals. The present invention also includes an anti-tamper mechanism for sounding an alarm when the apparatus is tampered with. The motion sensor and anti-tamper sensor are coupled to a computer which is in stand-by mode most of the time to conserve energy. When signals are sent to the computer, its software interprets the signals and generates an alarm when the computer determines that at least one of a plurality of predetermined motion values are met. The predetermined motion values include frequency of motion, duration of motion and intensity of motion. The alarm is sounded in increments of varying duration according to the interpretation of the signals by the software, thus providing warning signals and full alarms.

35 Claims, 11 Drawing Sheets

KEY PAD PROCESS (KPP)

PROGRAMMABLE MICROPROCESSOR BASED MOTION-SENSITIVE ALARM

FIELD OF THE INVENTION

This application is a continuation-in-part of Ser. No. 07/642,478, filed Jan. 17, 1991, now abandoned.

The present invention relates to anti-theft devices and more particularly, it relates to anti-theft devices capable of interpreting sensed motion.

BACKGROUND OF THE INVENTION

Theft of equipment, especially expensive electronic equipment such as computers is a large and growing problem. Schools and corporations are particularly vulnerable to theft because their equipment is typically accessible for extended periods of time to numerous people in open environments. Equipment is often stolen by insiders of an organization during normal working hours. Environments such as computer laboratories, typing classes, and shared offices are examples of places where theft is common. Continuous personnel monitoring of the equipment is very expensive and difficult to implement.

Many products have been developed to guard against theft of equipment. For example, one type is incorporates methods of mechanically fastening equipment to a secure fixture. Other types include methods for detecting motion by infra-red detectors, sonar or radar. These devices are expensive and are unsuitable for open work environment where access is not restricted during certain hours.

Methods also include attaching magnetic tags to equipment. However, every possible exit from the protected area must be equipped with expensive monitoring station to detect tags leaving. Additionally, the tags are relatively easy to shield from the monitors, allowing then to pass directly through monitoring stations undetected.

Manufacturers have incorporated many different combinations of securing mechanisms into their products including combinations of bolts, strong adhesives, cables, metal plates and mechanical lock. In addition to the obvious inconvenience of fixing equipment to one place and preventing small movement of equipment in the course of normal work, the mechanical means can be pried, cut or broken during periods when these destructive methods will not be detected. Products which rely solely on mechanical fastening ineffectually rely exclusively on deterrence, since they do not detect and identify attempts to tamper with the protection.

There are also anti-theft devices which detect motion of the equipment by motion sensors attached to the equipment. Typically, a device of this type detects motion and sounds an alarm. These anti-theft devices do not have the capability of detecting motion and interpreting the motion to determine if is the type of motion for an which alarm should be sounded. In other words, anti-theft devices of the prior art have little operational flexibility.

Anti-theft devices of the prior art also require a continuous power drain to monitor the motion detecting function. The continuous power drain either requires that the anti-theft device be plugging into an electrical outlet or use batteries which are frequently replaced.

SUMMARY AND OBJECTS OF THE INVENTION

It is a general object of the present invention to provide an anti-theft apparatus which deters, detects and prevents the theft of equipment.

It is another object of the present invention to provide an anti-theft apparatus which allows substantial operational flexibility.

It is a further object of the present invention to compare detected motion to a predetermined motion value which may include parameters such as frequency, duration and intensity of motion.

It is yet another object of the present invention to provide an anti-theft device which generates an alarm according to the type of motion detected.

It is still a further object of the present invention to provide an inexpensive yet versatile anti-theft device.

It is still another object of the present invention to provide an anti-theft device which is easily installed by a user.

Also, it is an object of the invention to provide an anti-theft device which draws substantially no power during its normal operation.

The foregoing and other objects of the invention are achieved by an anti-theft device and method which includes a motion sensor for detecting motion and generating signals. The present invention also includes an anti-tamper mechanism for sounding an alarm when the apparatus is tampered with. The motion sensor and anti-tamper sensor are coupled to a computer which is in stand-by mode most of the time to conserve energy. When signals are sent to the computer, its software interprets the signals and generates an alarm when the computer determines that at least one of a plurality of predetermined motion values are met. The predetermined motion values include frequency of motion, duration of motion and intensity of motion. The alarm is sounded in increments of varying duration according to the interpretation of the signals by the software, thus providing warning signals and full alarms.

DESCRIPTION OF THE PREFERRED EMBODIMENT

Reference will now be made in detail to the preferred embodiment of the present invention, example of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the claims.

Figure 1:
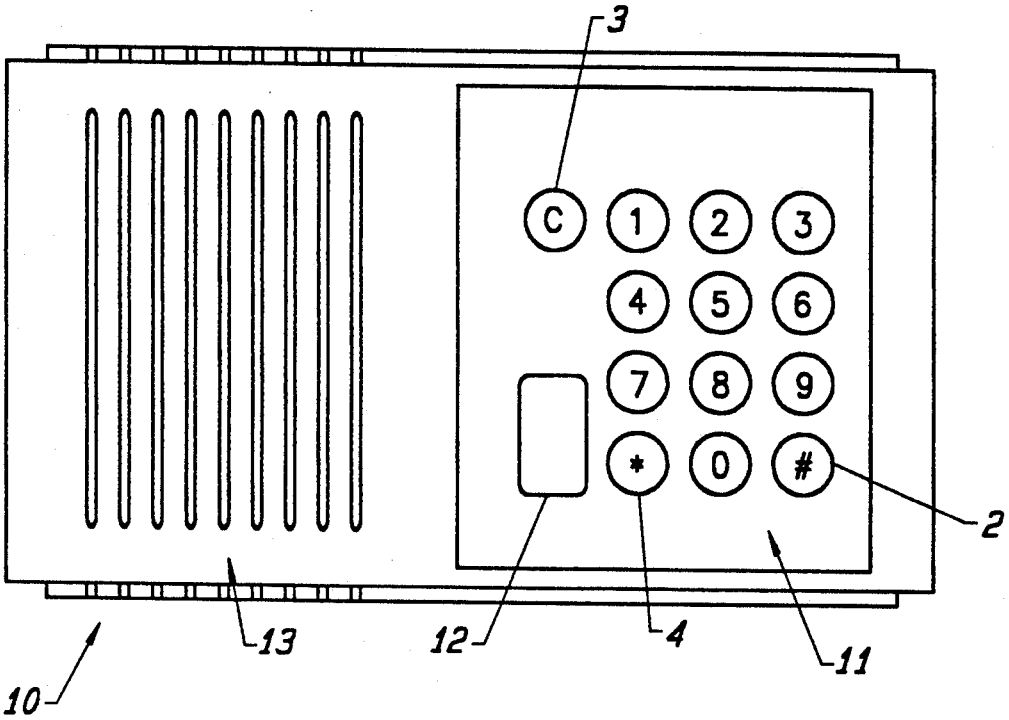
FIG. 1 shows a box type configuration of the present invention.

Turning now to the drawings, wherein like components are designated by like reference numerals, attention is initially directed to FIG. 1 which shows a box type configuration 10 of the anti-theft device of the present invention. Key pad 11, which resembles the configuration of a touch tone telephone, is provided as a user interface for setting a plurality of predetermined motion values. The user inputs various control parameters. Display 12 communicates keystroke and programming information to the user as well as other signals during an alarm of the present invention's operation. Display 12, for example, may be an LED.

Key pad 11 has a program selection key 2, denoted by a "#" which initiates programming and provides the ability for the user to access certain types of programming functions (some described below), such as the master identification (MID) program, the personal identification program (PID), the motion sensitivity program, the alarm loudness program, the alarm duration program and the alarm delay program. Battery check 3, denoted by "c" allows the user to check the state of the battery powering the present invention.

In order to enable or disable the system during an alarm mode, key pad 11 has disarm key 4, denoted by a "*" which allows the user shut off the alarm by inputting his/her identification number and then depressing the disarm key 4. With a keypad, the user must know the special user code, previously programmed, to enable the device or disable the device. The keypad can be implemented to allow master identification codes as well as personal identification codes. Master identification codes not only enable and disable, but also eliminate all other programmed codes. Alternatively, a hardware key lock 6 (see FIG. 5) may provided to disarm the anti-theft apparatus. The key serves to make an electrical connection when keyed on and opens a connection when the device is keyed off. Hardware keys can include master keys.

Speaker 13 which provides the alarm sound, is covered by a grill which prevents direct access to the speaker. The grill can extend around the side of the box to allow the sound to emanate from there as well. An audible alarm can be implemented using an amplifier, a transformer and a piezo electric buzzer. The signal to the buzzer can be digitally synthesized for the desired tome. The width of the pulses sent to the piezo buzzer determine the buzzer's volume. An alternative to a speaker for providing an alarm is an inaudible signal sent to another device to initiate an alarming function. Another alternative includes giving the apparatus the ability to be queried by a remote supervisor and indicating its location and status.

Figure 2:
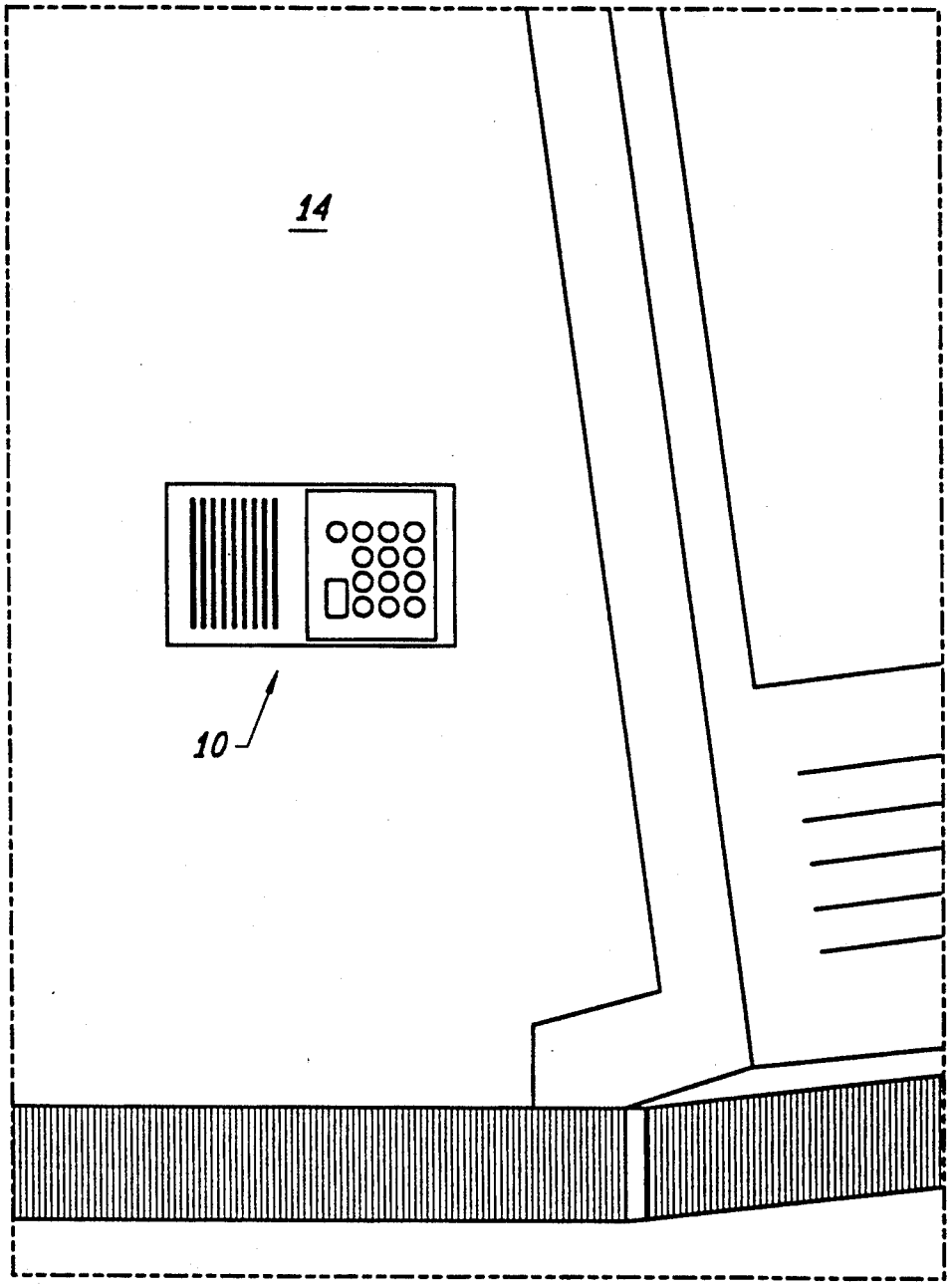
FIG. 2 shows a box type configuration of the present invention mounted, on the side of a computer terminal.
Figure 3:
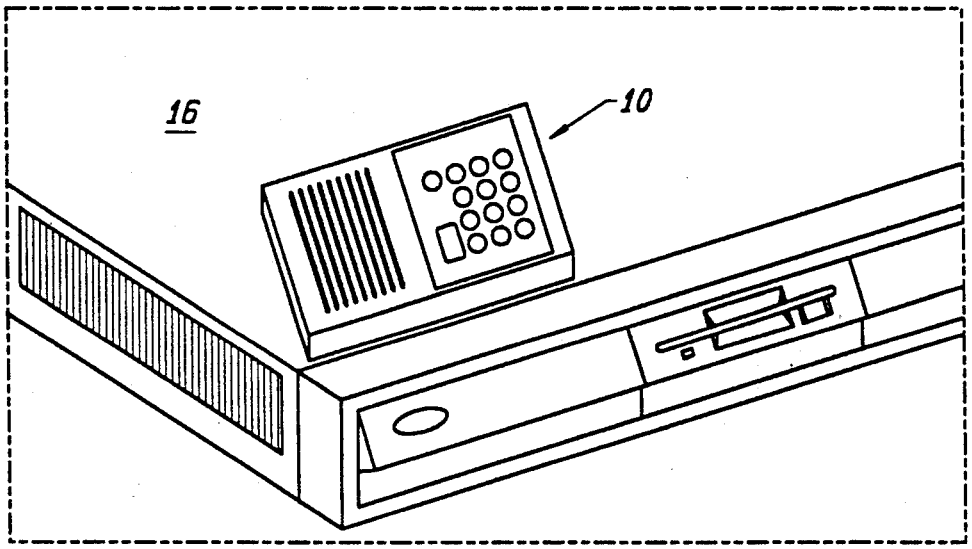
FIG. 3 shows a box type configuration of the present invention mounted a drive housing of a computer.

FIG. 2 depicts a box type configuration 10 of the anti-theft device of the present invention mounted to a computer terminal 14. FIG. 3 depicts a box type configuration 10 of the present invention mounted to a drive housing 16 of a computer. The means for mounting include strong adhesives or other attachment means like screws or bolts.

Figure 4:
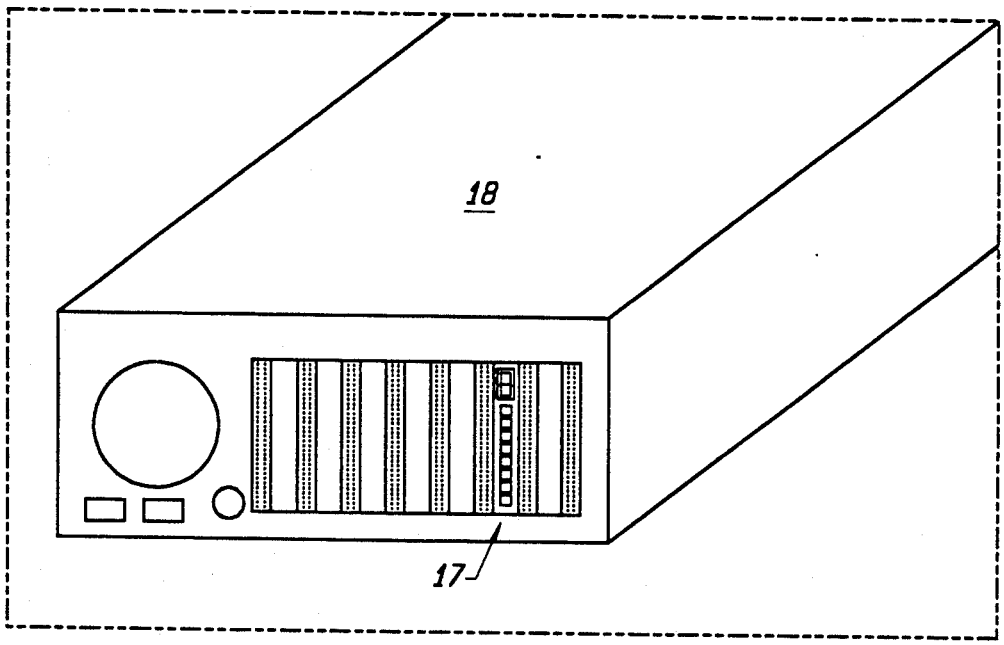
FIG. 4 shows a card type configuration of the present invention mounted in a computer.

An internal device, that is, a card type configuration 17 as shown in FIG. 4 is mounted inside a computer 18 in any standard expansion slot. The internal device 17 when placed internal to the computer often takes advantage of extra accessory plugs, or card slots in the computer, left by the original manufacturer for aftermarket products. Internally, the device may plug into an accessory plug and additionally use a screw to assure the device remains plugged in. The card 17 does not interact with the computer 18 and will not affect any of the computer's existing hardware and software. The card 17 however, does receive power from the computer to recharge its batteries.

Figure 5:
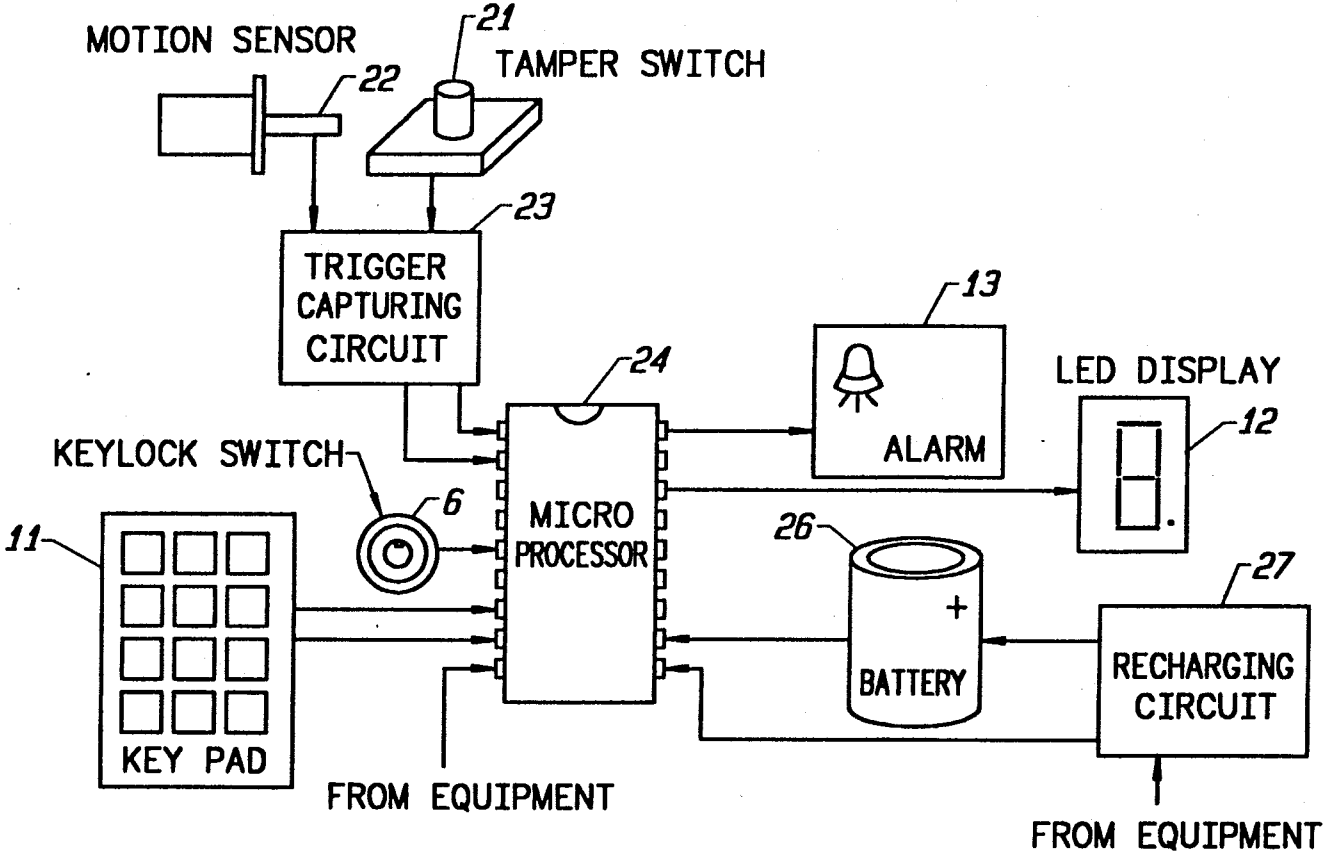
FIG. 5 shows a schematic diagram of the elements of the present invention.

FIG. 5 is a schematic diagram depicting the relationship between many of the components of the present invention. FIG. 5 shows an anti-tamper switch 21 of the present invention which sets off an alarm when actions are taken to destroy the anti-theft device or remove it from the equipment which it is protecting. A switch can be provided which is depressed when the device is mounted to the surface of the equipment. The switch is a spring loaded contact switch which, in its on position, protrudes from the surface facing the protected unit when the anti-theft device and the protected unit are not in contact. Actions taken to remove the device from the equipment will allow the spring to expand, changing the state of the switch and the circuit of which it is a part.

Another anti-tamper device includes the motion detecting features of the present invention, in that when a device is being tampered with, the device will necessarily experience motion which sets off the alarm.

Internal device 17 (FIG. 4) has an anti-tamper switch (not shown) which senses when the equipment's housing is being removed. The switch is designed to prevent someone from opening the equipment to remove the apparatus from the protected equipment.

The motion detecting means 22 of the present invention is any means which can change the status of an electrical circuit as the result of motion. A simple mercury switch can be used since it will open and close a circuit many times as a result of mercury movement within the switch during motion. Another motion detecting means may be a piezo sensor which changes its electrical resistivity within the circuit as a result of its motion.

When either motion and/or tampering is detected, the signal capturing means 23 keeps track of the pulses and information about the pulses including their duration, frequency and intensity, and/or the time between pulses. Signals or pulses are generated by the motion detecting means 22 or by the anti-tampering means 21 when their status is changed within the circuit. The signal capturing means 23 may be a microprocessor, that is, part of microprocessor 24 or an independent microprocessor.

The microprocessor 24 is essentially a computer which serves as the logic means for interpreting the motion signals received from the signal capturing means 23 by comparing them to a plurality of predetermined motion values when the motion sensor 22 detects that motion has occurred. The software of the system (described in detail below) is executed by the microprocessor 24 which interprets the motion signals and generates an alarm signal when the software determines that at least one of the plurality of predetermined motion values are met. In other words, microprocessor 24 interprets the pulses and provides control for the operation of the apparatus accordingly.

To conserve energy, the microprocessor 24 remains in a dormant "stand-by" mode most of the time. Microprocessor 24 is preferably, only placed in an "active" mode by the signal capturing means 23 when motion or anti-tampering signals have been generated. Key pad programming is performed only when the signal processor is in the active mode, that is, is not in stand-by mode.

The ability to spend time in the "stand-by" mode is an important feature of the present invention. By remaining in "stand-by" mode, the energy of the power supply 26 is conserved. The power supply 26 is typically a battery. If the internal configuration 17 is used, there is often an ability to tap into the protected equipment's power supply. For computers, the expansion slot used to hold the apparatus actually has connections to the power supply. Essentially, the plug used to affix the device to the internals of the protected equipment can also bring a source of power to the device. By providing the apparatus with a rechargeable battery power supply and a recharging circuit 27, the power supply can be recharged every time the protected equipment is on.

Figure 6:
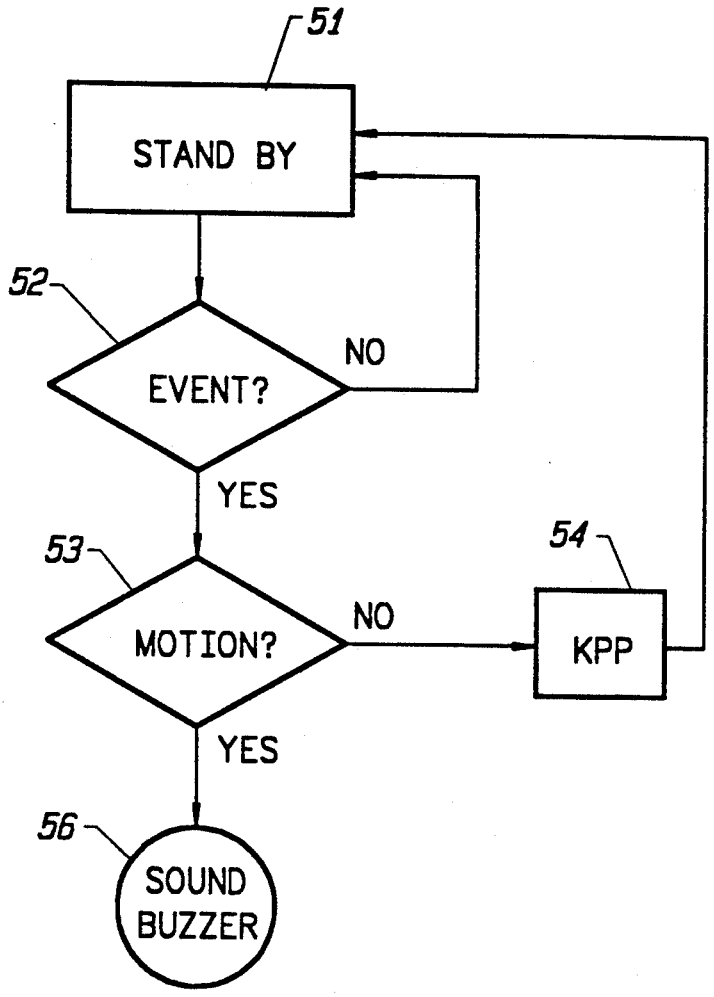
FIG. 6 is a flow chart of the general operation of the present invention.

FIG. 6 is a flow chart of the general operation of the present invention. After a cold start has been initiated and the system is operating, the system goes to "stand-by" mode 51. It remains in stand-by mode 51 until an event 52 occurs. If in fact it was not an event as defined by the programming (which includes motion or key pad inputs by a user), the system returns to stand-by mode 51. However, it was an event as defined by the programming, the system checks to see if the event is motion or tampering as defined by the programming. If it was not motion or tampering, the system runs through its "key pad process" (see FIG. 8), and ultimately returns to stand-by mode 51. If motion or tampering was in fact detected, the buzzer sounds 56. The system typically spends approximately 95% of the time in stand-by mode, and therefore, the important function of conserving energy is effected.

Should motion be detected, the apparatus can be programmed to immediately sound a warning to the offender with a quick pulse of its alarm. Should motion continue longer than a specified time, the apparatus will sound a full alarm either indefinitely or until a specified length of time has passed where the device has remained stationary. If a full alarm has been sounded and then stopped due to a stationary position, addition motion will bring a full alarm, not another warning. To reset the apparatus to provide warnings, the apparatus must be disabled and then enabled again using the key or special code and keypad.

FIGS. 7-10 illustrate the programming of the preferred embodiment of the present invention. Microprocessor 24 (see FIG. 5) is designed to be programmable by the user through the user interface, key pad 11. Motion sensitivity is a programmable function of the present invention. Motion sensitivity includes frequency of motion, duration of motion and intensity of motion which are parameters defining different types of motion. The microprocessor 24 is given the ability to interpret motion according to these parameters (described in conjunction with FIG. 10 below).

The interpretation of motion is a critical feature of the present invention because it provides substantial operational flexibility. For example, if a user determines that the equipment to which the anti-theft device is mounted is subject to many routine disturbances, the user may program the device for a very low sensitivity. Therefore, the frequency, duration and intensity of the motion will need to be quite high in order for the full alarm to be sounded. Types of equipment which may be routinely moved due to bumping or shifting may include laser printers, telephone equipment, copy equipment and automobiles.

On the other hand, a user might determine that the equipment to which the anti-theft device is mounted is not subject to many routine disturbances. In that case, the user may wish to program the device with a high sensitivity. Types of equipment which are not routinely moved may include computer terminals and facsimile machines. The amount of sensitivity with respect to a type of equipment is a variable to be determined by the user. In the preferred embodiment, there are eight sensitivity levels, however, fewer or more may be allowed.

Other important features which are described below include the alarm duration level, which is the duration of the alarm after the motion stops. Also included are means to program a warning alarm which may be sounded prior to a full alarm. Further included is the ability to program an alarm delay which give the user an opportunity to disarm the anti-theft device before the full alarm begins to sound.

Figure 7A:
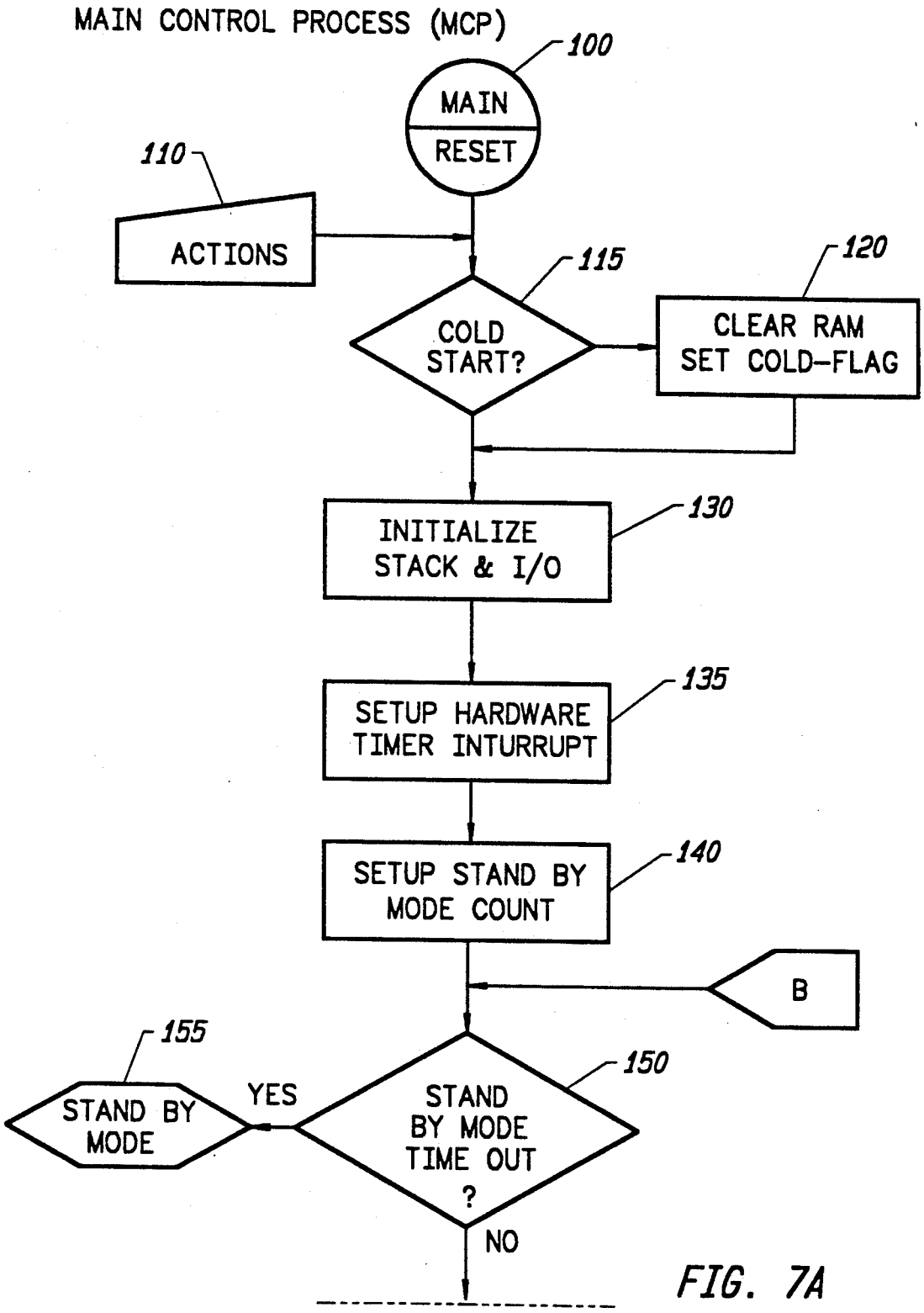
FIGS. 7A and 7B is a flow chart of the main control process (MCP) of the present invention.
Figure 7B:
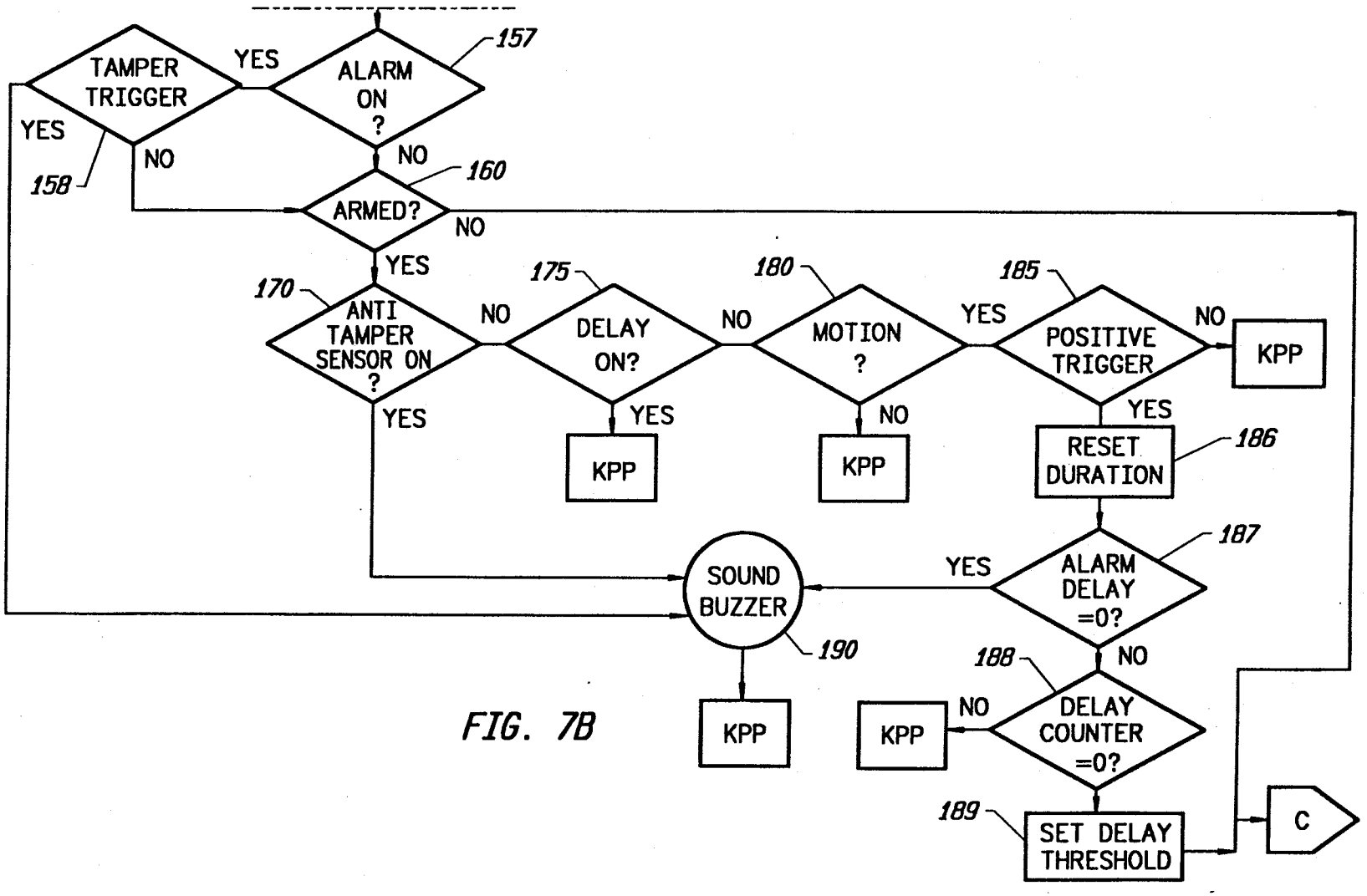

FIGS. 7A and 7B shows the main control process (MCP) which manages the overall operation of the apparatus. The MCP begins control when the power supply is supplied to the circuit. The MCP manages the change from "stand-by" to "active" states which conserves energy.

Two types of events can cause the microprocessor to enter the "active mode" from stand-by, shown as loop 100. These events are initiated by hardware external to the microprocessor. The first type of event is when the battery 26 is connected to the microprocessor 24 for the first time.

The second group of events are actions, 110 which can be further divided into two action types. The first type of action may be a signal (pulse) generated by one of the anti-tamper sensor 21. The anti-tamper sensor 21 is designed to generate a signal immediately when the antitheft device is tampered with. The signal from an antitamper switch 21 stays in the "on" state once triggered. Some initial bounce of the signal may be seen.

The second type of action is generated by the motion sensor 22. The motion sensor 22 generates a signal or multiple signals when the anti-theft apparatus is moved. Motion sensors 22 typically generate signals which quickly change states between "on" and "off."

The signals generated by the anti-tamper sensor 21 and the motion sensor 22 may be of a very short duration and therefore may be in the on-state or the off-state when the microprocessor 24 investigates the condition of the sensors. Therefore, the trigger capturing circuit 23 captures the signals and allows the microprocessor 24 time to process the signals. After a signal has been processed, the trigger capturing circuit 23 is reset (see 186 in FIG. 7B) by the microprocessor to accept a new signal.

There are, in the preferred embodiment of the present invention, four important routines in the microprocessor 24 programming. These include the Main Control Process (MCP), the Sensor Checking Process (SCP), the Key Pad Process (KPP) and the Learn Mode and Alarm Mode Process (which originates in KPP). Alternative programming embodiments may be envisioned which would accomplish the same ultimate objectives of the present invention.

Figure 8:
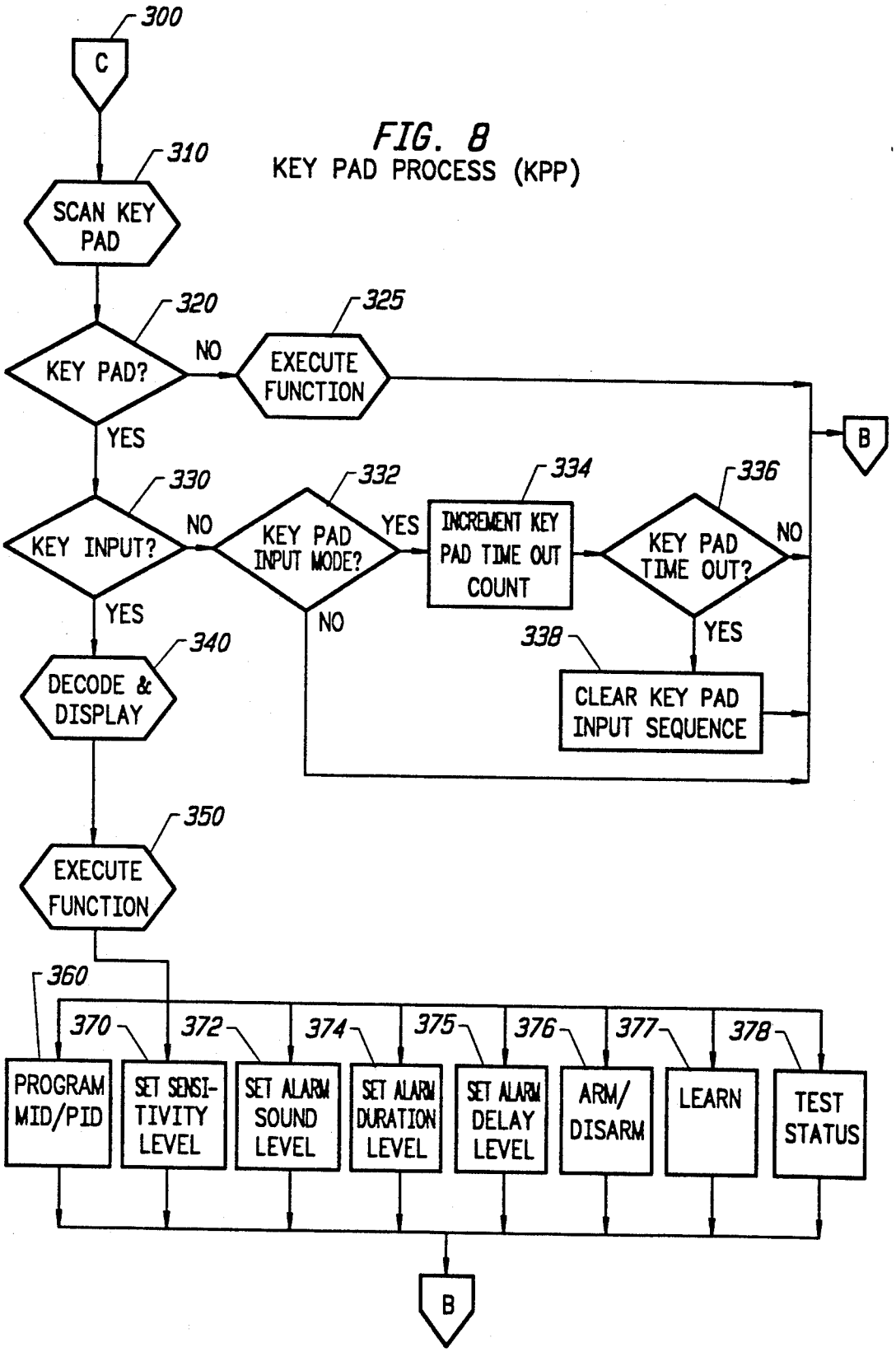
FIG. 8 is a flow chart of the key pad process (KPP) of the present invention.
Figure 9:
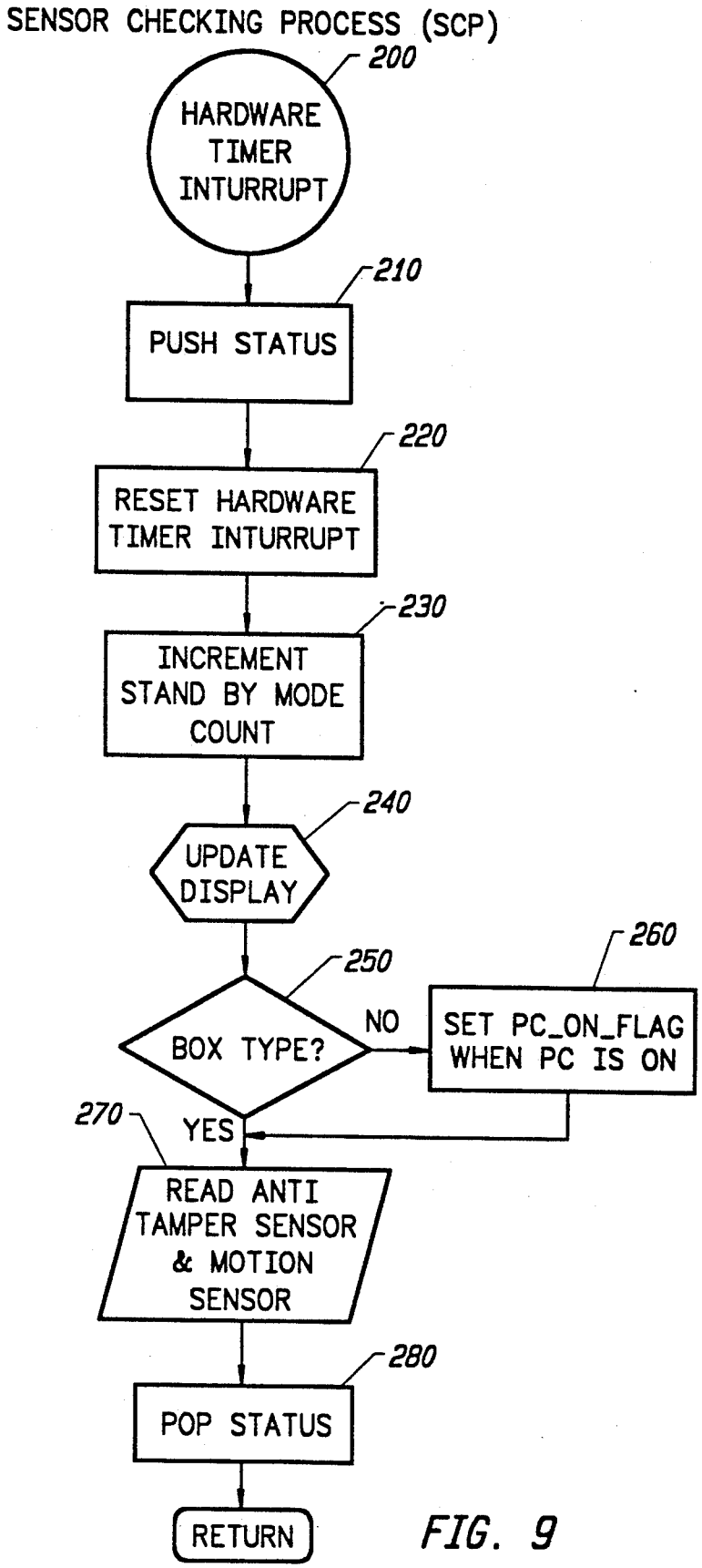
FIG. 9 is a flow chart of the sensor checking process (SCP) of the present invention.

There a several ways for the system to go from MCP to either KPP (see FIG. 8) or SCP (see FIG. 9). For example, after the MCP shown in FIG. 7B has checked the sensors (see 170, checking anti-tamper sensor 21 or 185, the positive trigger) and no alarm action is required, the key pad process (KPP) shown in FIG. 8 takes over. If there has been input on the keypad 11 by the user, the KPP manages the programming, battery check, arming and disarming functions provided to the user.

A hardware interrupt 135 diverts the system from MCP to the sensor checking process, SCP. SCP is shown in FIG. 9 and performs critically important activities which include monitoring the anti-tamper sensor, the motion sensor and time dependent events. The hardware interrupt 135 has been designed into the system to automatically perform sensor checking and signal capturing at specified time intervals. SCP has the highest priority of all of the process and is considered the preemptive process. The status of MCP (or KPP if diverted from KPP) is stored, the SCP is performed, and then the original MCP (or KPP) process is continued from where it was exited. Upon entering SCP, the microprocessor saves by pushing the status onto the memory stack 210.

The use of the hardware interrupt assures that sensor checking will always be performed on time and appropriate actions will follow. By design, the SCP is kept as simple as possible with practically no computation tasks to ensure the complete process is completed in a timely manner.

The hardware time interrupt is a hardware event. It is not reset automatically. The microprocessor needs to reset for the next interrupt 220 upon completion of the previous interrupt. If the last interrupt is before the stand-by mode is initiated, the microprocessor will not reset the interrupt.

All the time sensitive activity and counters are incremented in block 230. The time sensitive activities include: the stand-by mode time, the key pad time out, the alarm duration, and the alarm delay.

In order to conserve stored electrical energy, the display is only turned on for a very short period of time during SCP 240, just long enough to let the eye know what is displayed. Typically, the human eye can't respond to any change faster than one tenth of a second, so it is updated slightly more rapidly than 10 times per second.

The cost of having separate software programs for external 10 and internal products 17 is very high in terms of the cost of the microprocessor. Therefore, by design, there is one mask ROM microprocessor for both configurations. In order to accommodate the box and the internally installed anti-theft apparatus, the microprocessor checks whether the apparatus is of the external or internal type 250. For the internally installed type, the microprocessor checks the power supply status of the equipment 260.

The power supply of the equipment is connected to an input port of the microprocessor of the internal type 17. If there is power from the equipment, the microprocessor will ignore the motion sensor 22 input. However, the anti-tamper 21 input will not be ignored.

The microprocessor of the anti-theft apparatus checks the status of the anti-tamper sensor and the motion sensor 270. If it cannot detect an anti-tamper sensor "on" state, a motion is assumed. The microprocessor sets the appropriate flags which will be used in the main reset loop 186. The micro processor will reset the trigger capturing circuit 23.

The microprocessor then prepares to return to either MCP or KPP at the spot where it left when the hardware timer interrupt was activated. The microprocessor returns in an orderly manner, by restoring the status at the point of interrupt by "popping" the status from the memory stack 280. The microprocessor returns 290 to the MCP or KPP after it has popped the status.

Once MCP of FIG. 7A and 7B has been entered or re-entered, the microprocessor of the anti-theft apparatus checks the cold start flag 115 to determine if has to perform start up activities. If it is a cold start, the microprocessor performs the cold start activities 120. The first cold start activity is to clear the random access memory. The second is to set up all of the default values. The third activity is to set a software flag, the cold start flag, indicating that the cold start activities were performed successfully.

The microprocessor 24 next begins to perform routine tasks such as initializing the stacks and the input output sub-system 130. The hardware timer interrupt 135 which initiates activity in the SCP, is set allowing critically important activities to be performed by the microprocessor. This interrupt, as noted above, is a preemptive interrupt which suspends all the normal processes in the MCP (FIG. 7A and 7B),. or KPP (FIG. 8) to initiate activity in the SCP (FIG. 9).

The final step in the initialization of the MCP is the setup of the Standby Mode Counter 140. At this point in the MCP, the microprocessor 24 will begin processing information in a large loop, beginning with the check of stand-by mode time out 150, which can place the MCP in the stand-by mode 155. The stand-by mode counter 140 is managed as one of the time sensitive processes in the hardware time interrupt activity. As part of the process of going to the stand-by mode 155, the microprocessor 24 was programmed to save its complete status, including the programmed features.

As noted above, in normal operation, the anti-theft apparatus of the present invention is in the stand-by mode approximately or more than 95% of the time. The reason for the stand-by mode 155 is to conserve stored electrical energy of the battery 26. In this mode, the microprocessor 24 requires only a few micro-amperes to maintain it status instead of a thousand times that amount during normal processing.

The only method by which to return to an active mode in which the microprocessor 24 begins processing again from the stand-by mode is by one of the actions of 110. The cold start actions 120 are not required. The MCP initiation steps 130, 135 and 140 are again quickly executed.

After checking the stand-by mode time out 150, and finding that the stand-by mode is not yet to be entered, the large processing loop of the MCP continues to check whether the apparatus is alarming 157. It then checks to see whether it is alarming due to motion or tampering 158. If it is alarming due to tampering, MCP initiates the KPP of FIG. 8 (after buzzer 190) immediately, otherwise a check is made as to whether the unit is armed 160.

If the unit is armed 160, the microprocessor of the anti-theft apparatus proceeds to test the anti-tamper sensor 170. If the anti-tamper sensor is turned on, the sound buzzer will be turned on immediately until the energy stored in the battery is depleted or the anti-theft apparatus is disarmed.

If the anti-tamper sensor 170 is not on, the apparatus checks to see whether the alarm delay 175 is on. If there is an alarm delay 175 on, the MCP initiates KPP of FIG. 8. If the Alarm delay 175 is off, the motion sensor 180 is checked. If motion is detected, the microprocessor will proceed to ensure there is a "positive trigger" 185. If there is a positive trigger, then the alarm duration counter is reset 186, and if the programmed alarm delay is set to zero, the buzzer 190 sounds. If the programmed alarm delay 187 is nonzero, and the alarm delay counter 188 is zero, the alarm delay threshold is established and the threshold delay counter 189 is set. Ultimately, KPP is initiated.

If there is a delay, a continuous alarm will sound after an alarm delay counter exceeds the alarm delay period, as monitored by and as part of the SCP interrupt controlled process.

The positive trigger check assures that the alarm will not sound continuously unless there is significant motion as defined by the user, therefore false alarms are minimized. In practice, there will be accidental motions in a normal operating environment. The microprocessor of the anti-theft apparatus is programmed to distinguish between accidental motions and a series of motion, measured in time by the microprocessor 24. The apparatus has a default positive trigger time value that is suitable for most applications. Since the apparatus is designed to protect a wide variety of equipment, the apparatus can be programmed by the user to report a positive trigger over a wide range of times. The details of the positive trigger set up process is inputted by the user under 370 of the KPP of FIG. 8.

The signal interpreting microprocessor 24 may see one isolated pulse of short duration which has been observed by the motion detecting means 22 and stored by signal capturing means 23. The signal interpreter may be programmed to ignore this pulse, perhaps a small acceptable movement in the equipment with respect to the environment, and therefore initiate no action.

The signal interpreting microprocessor 24 may see many pulses and trigger a short warning alarm from the alarm means 13. Continued observation of the pulses over a previously specified time may result in the signal interpreter triggering a continuous alarm. A period of no pulses after a triggered alarm may cause the interpreter 24 to silence the alarm.

The logic of the signal interpreting microprocessor 24 is embedded in the software used to control that portion of the microprocessor's functions. The software can be written to allow user definable parameters. For devices with a programming means such as a key pad 11, the key pad 11 can be used to "program" the time duration of the pulse necessary to trigger a full alarm, the intensity of the motion to trigger a full alarm and the frequency of the motion necessary to trigger a full alarm. Clearly, other parameters may be programmed into the microprocessor depending upon the sophistication of the software.

Figure 10:
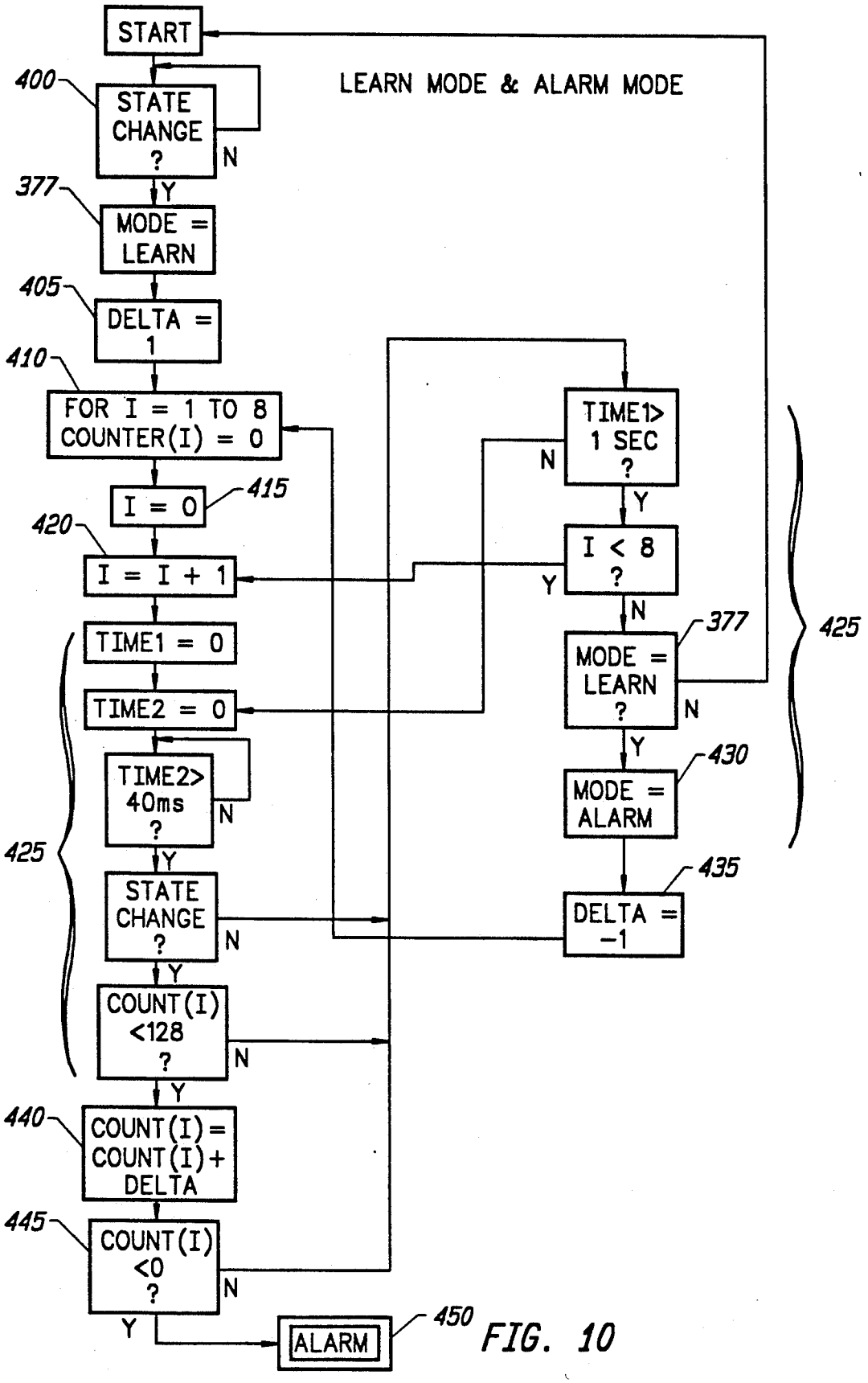
FIG. 10 is a flow chart of the learn mode and the alarm mode of the present invention.

FIG. 10 illustrates the logic of the interpreting microprocessor 24 of the preferred embodiment of the present invention which provides logic means for determining whether the detected motion is equivalent to a predetermined motion value. The predetermined motion value, as described above, is programmable or is a default threshold value which must meet in order to generate an alarm signal. As stated above, the motion detector 22 changes the state 400 of the circuit whenever motion is detected. The state of the circuit remains open when the motion stops.

In the preferred embodiment a "count down" programming method is utilized which determines if the motion value has been met. If the- motion value has been exceeded, the motion value has also been met. In an alternative embodiment, programming may be utilized which compares the detected motion to a predetermined motion value to see if the detected motion exceeds the predetermined motion value.

Furthermore, depending upon the type of sensor used, different types of motion values may be detected. For example, intensity may be detected by a piezo electric sensor whereas frequency of motion or duration of motion may be detected by a mercury switch. Other motion sensors may be used and other types of motion values may be sensed, accordingly.

In the count-down programming method of the preferred embodiment, the learn mode 377 takes place in an 8-second period. The circuit contains 8 counters. Each counter denoted by an increment (I) monitors a successive second of the 8-second period. During each second, an individual counter keeps track of the state of the motion detector 22. The learn mode normalizes its values to 1 (at box 405).

The counter can count 128 events. The circuit checks the state of the motion detector every 4 ms. If the detector has changed states during that period, the counter (at box 420) adds 1 to its count which first starts at (I=0 at box 410). The counter reaches its maximum value of 128, if the state changes are detected during 4 times 128 or 512 ms of the 1000 ms sample period (block of boxes 428). The system uses 8 of these counters to characterize, or learn, the first 8 seconds of the incident.

The alarm mode (at box 430) is identical to the learn mode, except that it subtracts 1 (at box 435) from the active counter every time it detects a motion sensor state change during the 4 ms sample period. If any of the counters reaches 0 (at box 445), the alarm is turned on (at box 450).

If the number of state changes in any of the last 8 seconds exceeds the number in the corresponding second in the learn mode (at box 440), the alarm sounds (at box 45). The following example illustrates the operation:

| Second | | 1 | 2 | 3 | 4 | 5 | 6 | 7 | 8 |
|---|---|---|---|---|---|---|---|---|---|
| Learn Mode | Plus Counts | 36 | 45 | 85 | 110 | 128 | 115 | 128 | 120 |
| | Counter Value | 36 | 45 | 85 | 110 | 128 | 115 | 128 | 120 |
| Alarm Mode | Minus Counts | 22 | 32 | 55 | 85 | 125 | 110 | 105 | 100 |
| | Counter Value | 14 | 13 | 30 | 25 | 0 | 5 | 23 | 20 |

The system learns the pattern of the incident during the first 8 seconds. During the second 8-second period, the system compares each second with the corresponding "learn" second by subtracting state changes from the same counter. In this example, the number of state changes in the fifth second in the second group exceeds the number of state changes in the fifth second in the learn group. The alarm sounds when the counter reaches zero. It never reaches the −10 value shown here.

As stated above, another method for determining whether the detected motion is equivalent to the predetermined motion values is to provide a comparison algorithm rather than a count down algorithm. In either case or in an alternative embodiment, the object of interpreting the motion is achieved.

FIG. 8 shows where the learn mode 377 is accessed. In other words, the user input of motion sensitivity through the learn mode is effected at KPP of FIG. 8. KPP is accessed after an event, such as the anti-tampering sensor 21 or the motion detector 22 has brought the microprocessor out of stand-by mode. When KPP is done with the key pad functions, it always returns to the MCP, so that the stand-by mode counter 150 is checked.

The KPP of FIG. 8 begins by first scanning the input port status of the keypad 310. If the apparatus has a keylock switch instead of a keypad, it is identified at 320. The two possible functions for the keylock are to arm or disarm. Accordingly, the appropriate flag is set. After the flag is set, the system returns to MCP.

If there is a keypad most of the time the anti-theft device will have no key input, since the microprocessor works much faster than the mechanical action of the key pad. If there is not key input 330, the microprocessor will check to see if there is an ongoing programming sequence taking place at box 332. If not, the system returns to MCP.

If there is an ongoing programming sequence, the programming sequence time out count 344, keeping track of the time since the last keystroke, is incremented and the time out limit 336 is checked. If the time out limit 336 is exceeded, the micro processor assumes the input operation is aborted, the preceding keys of the ongoing sequence are cleared, 338 and the microprocessor assumes the previous status before the MCP is returned to.

If there is a keypad input 330, the microprocessor decodes the input port status and sets up the display byte. Then depending on the decoded keystroke information, a program in the microprocessor 24 is executed for one of the following tasks (described above) to which the user supplies input through the key pad: (1) program the master identification or the personal identification; (2) set the sensitivity level; (3) set the alarm level; (4) set the duration of the alarm level; (4) set alarm delay; (5) arm/disarm; (6) status of the system.

Clearly, the general object of the present invention to provide an anti-theft apparatus which deters, detects and prevents the theft of equipment has been met. Also, the object of the present invention to provide an anti-theft apparatus which allows substantial operational flexibility has been met. Moreover, the object of the present invention to compare detected motion to a predetermined motion value which may include parameters such as frequency, duration and intensity of motion has been met. The object of the present invention to provide an anti-theft device which generates an alarm according to the type of motion detected has been met at well. Also, the object of the present invention to provide an inexpensive yet versatile anti-theft device. The object of the present invention to provide an anti-theft device which is easily installed by a user has also been met. Furthermore, the object of the invention to provide an anti-theft device which draws substantially no power during its normal operation.

While the invention has been shown and described in what is presently conceived to be the most practical and preferred embodiment of the invention, it will become apparent to those skilled in the art that many modifications thereof may be made within the scope of the invention, which scope is to be accorded the broadest interpretation of the claims so as to encompass all equivalent structures and devices.

I claim:

1. An apparatus for detecting tampering and theft in and of equipment, said apparatus operating in combination with a power supply for supplying power to said apparatus, said apparatus comprising:

power source means for obtaining power from said power supply;

user interface means for user changeable program setting of a predetermined motion value in said apparatus;

means for maintaining memory of said predetermined motion value after said value has been set;

motion sensor means for detecting motion of said equipment; and logic means for determining whether a motion detected by said motion sensor means is equivalent to said predetermined motion value when said motion sensor means detects that said detected motion has occurred, said logic means being operatively coupled to said motion sensor means for detecting motion and to said power source means for supplying power, said motion sensor means, said logic means, said user interface means, and said means for maintaining memory of said predetermined motion value drawing substantially no power from said power source means until said motion sensor means detects that said detected motion has occurred.

2. The apparatus as recited in claim 1, wherein said motion sensor means for detecting motion is a mercury switch.

3. The apparatus as recited in claim 1, wherein said plurality of motion values includes a motion intensity value, a frequency of motion value, and a duration of motion value.

4. The apparatus as recited in claim 2, wherein said motion sensor means for detecting motion is a piezo sensor.

5. The apparatus as recited in claim 1, further comprising means for generating an alarm signal in increments of varying duration, said means for generating operatively coupled and responsive to said logic means, said increments of varying duration established according to said determination of equivalence between said detected motion and said predetermined motion value.

6. The apparatus as recited in claim 1, wherein said substantially no power drawn by said logic means is power of about a few micro-amperes.

7. The apparatus as recited in claim 1, wherein said predetermined motion value includes a plurality of motion parameters.

8. The apparatus as recited in claim 7, wherein said plurality of motion parameters includes a frequency of motion value.

9. The apparatus as recited in claim 7, wherein said plurality of motion parameters includes a duration of motion value.

10. The apparatus as recited in claim 7, wherein said plurality of motion parameters includes a motion intensity value.

11. An apparatus for detecting tampering and theft in and of equipment, said apparatus operating in combination with a power supply for supplying power to said apparatus, said apparatus comprising:

power source means for obtaining power from said power supply;

a motion sensor which detects motion of said equipment and generates at least one motion signal when said motion is detected;

a computer which receives said at least one motion signal;

user interface means for user changeable program setting of at least one of a plurality of predetermined motion values in said computer;

said computer including memory means for maintaining memory of said at least one predetermined motion value;

said motion sensor, said computer, said user interface means, and said memory means for maintaining memory of said at least one predetermined motion value drawing substantially no power from said power source means until said motion sensor means detects that said detected motion has occurred; and software executed by said computer for interpreting said at least one motion signal and generating an alarm signal when said software determines that at least one of said plurality of predetermined motion values are exceeded.

12. The apparatus as recited in claim 11, wherein said plurality of predetermined motion values includes a frequency of motion value.

13. The apparatus as recited in claim 11, wherein said plurality of predetermined motion values includes a duration of motion value.

14. The apparatus as recited in claim 11, wherein said plurality of predetermined motion values includes an intensity of motion value.

15. The apparatus as recited in claim 11, wherein said plurality of predetermined motion values includes a frequency of motion value, a duration of motion value, and an intensity of motion value.

16. The apparatus as recited in claim 11, wherein said motion sensor is a mercury switch.

17. The apparatus as recited in claim 11, wherein said motion sensor is a piezo sensor.

18. The apparatus as recited in claim 11, wherein said alarm signal is generated in increments of varying duration according to said interpretation of said at least one motion signal.

19. The apparatus as recited in claim 11, wherein said substantially no power is power of about a few micro-amperes sufficient to maintain said computer status and said memory, said status including programmed features, until said motion sensor means detects that said detected motion has occurred.

20. An apparatus for detecting theft of equipment, said apparatus comprising:

a motion sensor which detects motion of said equipment and generates at least one whenever said motion is detected;

power means for supplying power to said apparatus; and a computer which receives said at least one signal and which draws substantially no power from said power means until receipt of said at least one signal from said motion sensor.

21. The apparatus as recited in claim 20, which is mounted external to said equipment.

22. The apparatus as recited in claim 20, which is mounted internal to said equipment.

23. The apparatus as recited in claim 20, wherein said computer draws power of about a few micro-amperes sufficient to maintain said computer status, said status including programmed features, until receipt of said at least one signal from said motion sensor.

24. An anti-theft apparatus attached to equipment for detecting tampering of said apparatus, said apparatus comprising:

anti-tamper means for generating at least one signal when an attempt is made to remove said apparatus from said equipment;

power means for supplying power to said apparatus, and a computer which receives said at least one signal and which draws substantially no power from said power means until receipt of said at least one signal from said anti-tamper means.

25. The apparatus as recited in claim 24, wherein said computer draws power of about a few micro-amperes sufficient to maintain said computer status, said status including programmed features, until receipt of said at least one signal from said anti-tamper means.

26. An anti-theft apparatus attached to equipment for detecting attempts of theft of said equipment, said apparatus operating in combination with a power supply for supplying power to said apparatus, said apparatus comprising:

power source means for obtaining power from said power supply;

anti-tamper means for generating at least one tamper signal when an attempt is made to remove said apparatus from said equipment;

motion sensing means for generating at least one motion signal when said apparatus is moved more than a predetermined amount;

a microprocessor configured to receive said tamper signal and said at least one motion signal and to make a determination whether said tamper and said motion signals meet predetermined criteria and to generate at least one response signal according to said determination;

said microprocessor drawing substantially no power from said power source means until receipt of said tamper signal or said motion signal; and alarm means for receiving said at least one response signal from said microprocessor and generating an alarm signal when said response signal has predetermined characteristics.

27. The apparatus as recited in claim 26, wherein said microprocessor draws power of about a few micro-amperes sufficient to maintain said microprocessor complete status, said status including programmed features.

28. An apparatus for detecting and indicating motion of personal computer equipment, said apparatus comprising:

motion sensing means for detecting motion of said apparatus;

signal means operatively coupled to said motion sensing means for generating a signal when said motion sensing means detects motion;

mode enabling means for enabling modes of operation of said apparatus, said enabling means comprising interface means for interfacing between said signal means and means for inputting commands, said mode enabling means being distinct and operating independently from said personal computer equipment;

said signal means responsive to said commands from said mode enabling means;

announcement means receiving said signal for indicating when said motion sensing means has detected motion;

mounting means for connecting said apparatus to said personal computer equipment;

power supply means for supplying power to said apparatus; and wherein said signal means draws substantially no power from said power source means until said motion sensing means detects motion.

29. The apparatus as recited in claim 28, wherein said substantially no power is power equivalent to about a few microamperes.

30. The apparatus as recited in claim 28, wherein said substantially no power is power sufficient to maintain status of said mode enabling means, including status of commands provided by said means for inputting commands.

31. The apparatus as recited in claim 28, wherein said power supply means for supplying power to said apparatus is a battery.

32. An electrically powered apparatus, receiving power from an electrical power supply, for detecting predetermined motions indicative of tampering or theft in and of equipment, said apparatus comprising:

power source means for providing electrical power from said electrical power supply to said apparatus;

user interface means for user programming of said apparatus;

said user programming including user setting of predetermined motion values;

motion sensor means for detecting motion of said equipment;

said motion sensor means generating pulse signals upon the occurrence of a sufficient prearranged amount of motion;

microprocessor means having a plurality of operating modes including an active mode and a stand-by mode; said active mode being activatable manually or by receipt of said pulse signals; said stand-by mode being activatable automatically in the absence of said pulse signals;

said microprocessor means including memory means;

said microprocessor means for determining whether a motion detected by said motion sensor means is greater than any of said predetermined motion values when said motion sensor means detects that said detected motion has occurred;

said microprocessor being operatively coupled to said motion sensor means to receive said pulse signals for detecting motion;

said motion sensor means being operatively coupled to said power source means but with the proviso that said motion sensor means draws no power until said motion sensor means detects that said detected motion has occurred;

said microprocessor drawing substantially no power when in said stand-by mode, said substantially no power being power only sufficient to maintain status of said microprocessor in said memory; said status including said user set predetermined motion values;

said microprocessor automatically switching to said active mode when said motion sensor means detects that said detected motion has occurred.

33. A method of detecting theft or tampering in and of equipment, said method comprising the steps of:

continuously sensing motion while said apparatus is operating;

generating pulse signals upon the occurrence of a sufficient prearranged motion;

activating a processor from a low-power stand-by mode to an normal-power active mode upon the receipt of at least one said generated pulse signal;

comparing characteristics of said pulse signals with predetermined motion values to determine if any of said predetermined motion values are exceeded;

generating an alarm if any of said predetermined motion values are exceeded;

deactivating said processor from sad active mode to said stand-by mode if said predetermined motion values are not exceeded.

34. The method in claim 33, wherein said pulse characteristics include frequency, intensity, and duration.

35. The method of claim 33, wherein said method further comprises the step of being programmed by a user.

* * * * *